US005231256A

United States Patent [19]

Yamagiwa et al.

[11] Patent Number: 5,231,256

[45] Date of Patent: Jul. 27, 1993

[54] PUFFER TYPE GAS-INSULATED CIRCUIT BREAKER

[75] Inventors: Tokio Yamagiwa; Toru Tsubaki; Koji Sasaki; Naoyuki Yamamoto; Koji Kurokawa; Naoki Amano, all of Hitachi, Japan

[73] Assignee: Hitachi, Ltd., Tokyo, Japan

[21] Appl. No.: 735,838

[22] Filed: Jul. 25, 1991

[30] Foreign Application Priority Data

Jul. 27, 1990 [JP] Japan ..... 2-197947
Aug. 21, 1990 [JP] Japan ..... 2-218184

[51] Int. Cl.[5] ..... H01H 33/70

[52] U.S. Cl. ..... 200/148 A; 200/148 R; 200/150 G

[58] Field of Search ..... 200/144 R-151, 200/148 R, 148 A, 150 G

[56] References Cited

U.S. PATENT DOCUMENTS

| | | | |
|---|---|---|---|
| 4,418,256 | 11/1983 | Graf | 200/148 R |
| 4,514,605 | 4/1985 | Pham Van | 200/148 A |
| 4,562,322 | 12/1985 | Yamaguchi et al. | 200/148 G |
| 4,716,266 | 12/1987 | Muscaglione et al. | 200/148 R |
| 4,791,256 | 12/1988 | Yonezawa et al. | 200/148 R |
| 4,939,322 | 7/1990 | Kashimura et al. | 200/148 A |
| 5,079,391 | 1/1992 | Koyanagi et al. | 200/148 A |

FOREIGN PATENT DOCUMENTS

| | | |
|---|---|---|
| 3535194 | 7/1986 | Fed. Rep. of Germany . |
| 2473777 | 1/1981 | France . |
| 60-212923 | 10/1985 | Japan . |
| 63-119121 | 5/1988 | Japan . |
| 1-37822 | 8/1989 | Japan . |
| 1043353 | 9/1966 | United Kingdom . |

OTHER PUBLICATIONS

Ibuki, K. et al. "Key Technologies for Developing a 420 KV 50KA GCB Interrupter Unit", 89 WM 077-9 PWRD, ©1989 IEEE, 7pp. (presented at IEEE/PES Winter Meeting, New York, N.Y. Jan. 29-Feb. 3, 1989).

*Primary Examiner*—J. R. Scott
*Attorney, Agent, or Firm*—Antonelli, Terry Stout & Kraus

[57] ABSTRACT

A puffer type gas-insulated circuit breaker is adapted to, when its movable electrode separates from a stationary electrode, enable an insulating gas blow toward an occurring arc to extinguish the same. An insulated nozzle is provided to direct the gas toward the arc and forms a gas passage in cooperation with an insulating cover which covers the movable electrode. The insulated cover is formed of an insulating material which contains a filler for preventing energy lines of the arc from entering the cover. Furthermore, the insulated cover has a specific inductive capacity greater than a specific inductive capacity of the insulated nozzle so as to reduce the electric field strength at the front end of the movable electrode.

13 Claims, 3 Drawing Sheets

PUFFER TYPE GAS-INSULATED CIRCUIT BREAKER

BACKGROUND OF THE INVENTION

The present invention relates to a puffer type gas-insulted circuit breaker for breaking or interrupting relatively large electric currents in a plant such as a transformer station, and, more particularly to an improvement in an insulated nozzle and an insulated cover disposed in the vicinity of a portion of a circuit breaker in which an arc occurs.

When a large electric current is interrupted by a circuit breaker of the above-described type, a high-temperature plasma arc occurs between a fixed or stationary contact and a movable contact, that is, between electrodes. The puffer type gas-insulated circuit breaker is adapted to extinguish the arc, by an insulating gas such as an SF6 gas blowing toward the arc. To this end, a cylindrical insulated nozzle having a throat portion is provided to surround the contact portion between the stationary movable electrodes. When either of the electrodes passes through the throat portion of the insulated nozzle as the electrodes are being separated, the gas of the above-described type flows through the throat portion toward the arc.

A circuit breaker of the type described above has been disclosed, for example, in Japanese Patent Unexamined Publication No. 60-212923 , wherein a substantially cylindrical insulated cover between the electrode and the insulated nozzle, the insulated cover and the insulated nozzle defining a gas passage therebetween and with the arc gas extinguishing passing through the gas passage.

The above-described insulated nozzle is usually made of a synthetic resin of electric insulation. However, there arises a case where, when an arc occurs at the time of current interruption, voids and carbon ar caused not only on the surface of the insulated nozzle but also in the inside thereof due to energy lines generated from the arc. In order to overcome this problem, Japanese Patent Publication No. 1-37822 proposes utilizing a filler of boron nitride power in a fluororesin for forming the nozzle to prevent the entrance of an arc thereinto.

Further, Japanese Patent Unexamined Publication No. 63-119121, corresponding to U.S. Pat. No. 4,791,256, has proposed an insulated nozzle for a circuit breaker, which is made of a fluororesin containing 0.3 to 1.0 wt % of boron nitride. Furthermore, in "KEY TECHNOLOGIES FOR DEVELOPING A 420 KV 50 KA GCB INTERRUPTER UNIT" 89 WM 077-9 PWRD, 1989 IEEE, description is made on pp.3 to 6 about a nozzle formed of PTFE in which a filler is mixed.

SUMMARY OF THE INVENTION

An object of the present invention is to provide a puffer type gas-insulated circuit breaker having an improved interrupting performance.

Another object of the invention is to provide, a gas-insulated circuit breaker having an improved insulated cover.

Still another object of the invention is to provide a gas-insulated circuit breaker which is capable of improving its opening/closing performance in a small current region as well as the interruption performance for a large electric current.

In order to achieve the above-described objects, the insulated cover is fashioned of a material for reducing the strength of electric field at the front end of the movable electrode.

According to one aspect of the invention, there is provided a gas-insulated circuit breaker for opening and closing an electric circuit comprising a stationary electrode, an electrode movable for coming into contact with and away from the stationary electrode, gas compression means for causing an insulating gas to blow or puff when the movable electrode separates from the stationary electrode, cover means for covering the movable electrode, and nozzle means for forming, in cooperation with the cover means, a passage for introducing the insulating gas from the gas compression means to an arc occurring between the stationary and movable electrodes. At least the cover means is made of an insulating material which contains a filler for preventing invasion or penetration of energy lines of the arc.

The insulated cover thus formed prevents the penetration of energy lines of an arc which occurs at the time of the separation of the electrodes, and the adsorption of its energy is prevented. Therefore, the generation of carbon and voids in the insulated cover can be suppressed so that the distribution of electric potential at the front end of the movable electrode and the flow of the blowing gas are not disturbed and the interruption performance of the circuit breaker can be improved.

Preferably, the insulating material is a fluororesin and the filler is boron nitride powder. The nozzle means may be made of the same insulating material as that of the cover means, and it is preferable that the nozzle means, similarly to the cover means, contains a filler for preventing the penetration of the energy lines of the arc. Furthermore, it is preferable that the material for the cover means and that for the nozzle means be selected in such a manner that the specific inductive capacity of the cover means is greater than that of the nozzle means. Alternatively, in a case where the cover means and the nozzle means are made of the same material, it is preferable that the rate of the filler to be contained in the cover means be equal to or greater than that of the nozzle means.

By enlarging the specific inductive capacity of the cover means than that of the nozzle means, equipotential lines at the front end of the movable electrode when the electrodes separate are shifted toward the stationary electrode. As a result, the electric field strength at the front end of the movable electrode decreases, and the opening/closing performance in a small current region as well as the interruption performance for a large current can be improved. Accordingly, it is possible to provide a circuit breaker which can be adapted to the enlargement of voltage to be dealt with.

BRIEF DESCRIPTION OF THE DRAWINGS

The above and other objects, features and advantages of the invention will become more clear from the following description when taken in connection with the drawings, wherein.

DESCRIPTION OF THE PREFERRED EMBODIMENTS

Figure 1:
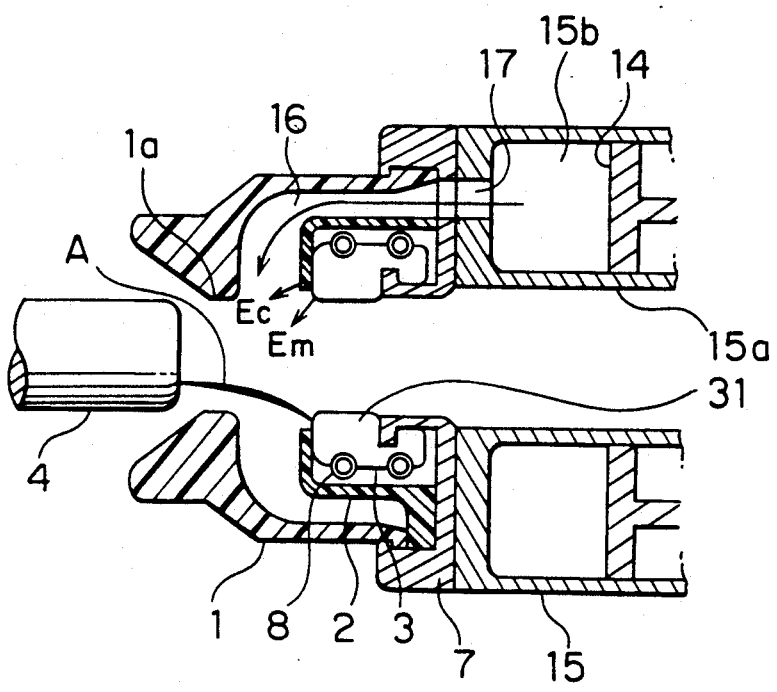
FIG. 1 is a sectional view of an interrupting section of an SF6-gas insulated circuit breaker according to an embodiment of the invention.

As described above, the insulated nozzle for a circuit breaker is, according to the conventional technology, made of a fluororesin which is mixed with a filler, and prevents the invasion or penetration of the energy lines of an arc which occurs when the interruption of a large electric current. Thus, one of critical factors for determining the performance of the gas-insulated circuit breaker can be ensured, but the insulated cover has not been considered to be so critical for the interrupting performance.

However, when the interrupting capacity per an individual interruption point of a circuit breaker is increased, also in the insulated cover, the generation of voids and carbon due to the penetration of the energy lines of the arc becomes an issue. That is, since the insulated cover is disposed adjacent to the movable electrode, the carbon generated will disturb the distribution of electric potential at the front end of the movable electrode, causing the interrupting performance to be deteriorated. Furthermore, the carbon generated on the surface of the insulated cover adheres onto the inner surface of the insulated cover to lower the insulating characteristics, or the voids generated will adversely affect the flowing characteristics of the blowing gas. Thus, it has been founded that there is a case where, due to the provision of the insulated cover, the interrupting performance is rather deteriorated as compared with the circuit breaker which is provided with only the insulated nozzle.

Moreover, with the reduction in size and enlargement of the capacity of the interrupting portion of a circuit breaker, the quantity of the filler such as boron nitride mixed in the nozzle material has been increasing to improve the arc resistance of the insulated nozzle. As a result, there is a tendency that the specific inductive capacity of the nozzle undesirably increases. Such increment of the specific inductive capacity of the nozzle, however, brings about a fear that the strength of electric field at the front end of the movable electrode is enlarged to involve a larger voltage acting thereon to thereby cause the deterioration of the interrupting performance.

That is, in the conventional circuit breakers, in either case where the cylindrical insulated cover is provided on the outer periphery of the movable electrode to define the gas passage in cooperation with the insulated nozzle or when no insulated cover is provided, no consideration is given to reduction of the electric field strength on the front end side of the movable electrode. Therefore, there arises a problem that the dielectric strength between the stationary and movable electrodes declines and the opening/closing performance in a small electric current region, in particular, the opening/closing characteristics of a small leading current will be deteriorated.

Accordingly, in the present invention, the insulated cover of a gas-insulated circuit breaker is aimed at and improved in such a manner that the generation of carbon and voids due to the energy lines of the arc are prevented and the electric field strength at the front end of the movable electrode is reduced.

Figure 2:
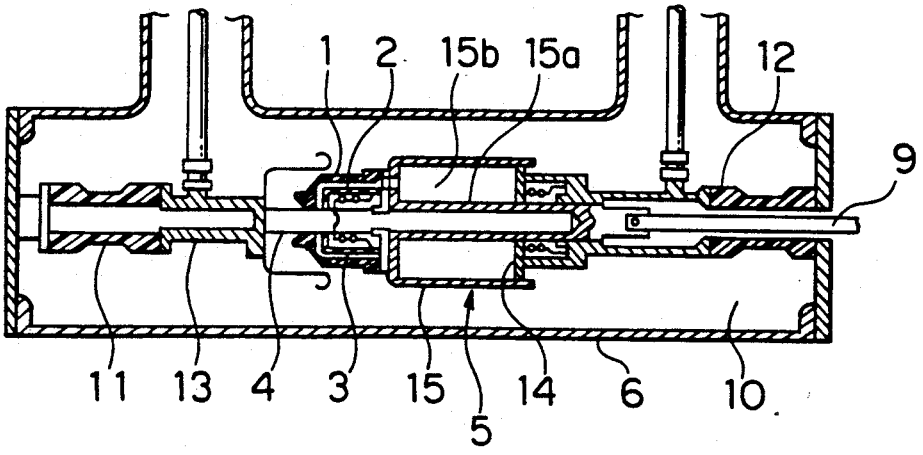
FIG. 2 is a sectional view which illustrates the overall structure of the circuit breaker shown in FIG. 1.

Referring first to FIG. 2, the overall structure of an SF6 gas-insulated circuit breaker according to the invention includes an elongated gas tank 6 in which an SF6 gas 10 is hermetically filled and an interrupting section is provided. The interrupting section is mounted between the opposite ends of the gas tank 6 via two insulating supports 11 and 12 to be electrically insulated from the gas tank 6.

The interrupting section comprises a movable contact or electrode 3, a stationary contact or electrode 4 which is disposed to oppose to the movable electrode, a gas compressing device 5, etc. The interrupting section is adapted to bring the movable electrode into contact with the stationary electrode or separate the former from the latter to open and close an electric circuit. Furthermore, an insulated nozzle 1 is provided to surround the contact portion between the electrodes 3 and 4, and an insulated cover 2 is disposed between the insulated nozzle 1 and the movable electrode 3.

The stationary electrode 4 is supported at one end of the gas tank 6 with the insulating support 11 via a conductor 13, and extends in a longitudinal direction of the gas tank 6. At the other end of the gas tank 6, the insulating support 12 supports a piston 14 of the gas compression device in a direction toward the stationary electrode 4. Further, a drive shaft 9 of an electrically insulating rod is provided to concentrically extend through the insulating support 12 and the piston 14. The drive shaft 9 is slidable with respect to the insulating support 12 and the piston 14, and an end of the drive shaft 9 is connected to an operation unit, (not shown) disposed at the outside of the gas tank 6.

The gas compression device 5 includes the piston, 14 and a cylinder 15 which is slidably coupled to the piston 14. The cylinder 15 is in the shape of a cylinder an end of which is closed, and has a shaft **15*a* disposed at the axial center portion thereof. The central shaft 15*a* is connected to the other end of the drive shaft 9 so that the cylinder 15 is moved on the piston 14 through the operation of the drive shaft 9. In response to this movement, a space, defined in the cylinder by the piston 14, increases or decreases to serve as a puffer chamber 15*b*** for compressing the SF6 gas.

As shown in FIG. 1, the movable electrode 3 comprises a plurality of contacts 31, and is held at the front end of the cylinder 15 via a cylindrical conductor 7. The contacts 31 are disposed in the circumferential direction of the conductor 7 to surround the stationary electrode 4, and are pivotally engaged with the conductor 7. An annular spring 8 is attached around the contacts 31 so as to urge the contacts 31 against the stationary electrode 4.

The insulating cover 2 is in a substantially cylindrical shape to surround front ends and peripheral portions of the contacts 31, and is attached to the conductor 7. Also the insulated nozzle 1 is attached to the conductor 7 in such a manner that it surrounds the insulated cover at a substantially fixed interval therefrom. The insulated nozzle 1 and the insulated cover 2 define a gas passage 16 therebetween, with the gas passage 16 being in communication with the puffer chamber 15*b* through an opening 17 formed in an end of the cylinder 15. The insulated nozzle 1 has a reduced diameter portion or a throat portion 1*a* on its side adjacent to the stationary electrode 4. The outlet of the gas passage 16 bends along the throat portion 1*a* and is directed toward the contact portion between the stationary and movable electrodes 3 and 4.

The shape and position of the insulated nozzle 1 and those of the insulated cover 2 are such that the rate of change in cross sectional area of the gas passage 16 is substantially constant from the upstream end of the passage to the downstream end thereof. With this arrangement, the pressure loss of the gas in the gas passage 16 can be prevented.

The insulated cover 2 is made of an insulating material composed of a fluororesin, for example, an ethylene tetrafluoride resin and boron nitride powder contained therein as a filler which obstructs the energy lines of an arc. Also, the insulated nozzle 1 is made of an insulating material which is composed of a fluororesin, for example, an ethylene tetrafluoride resin, or an insulating material which is composed of, similarly to the insulated cover 2, a fluororesin and boron nitride powder contained in the fluororesin. In the case where the insulated nozzle 1 is made of the latter insulating material, the rate of content of the filler must be equal to or lower than that of the filler contained in the insulated cover 2.

The current interrupting operation of the SF6 gas-insulated circuit breaker according to this embodiment will now be described with reference to FIGS. 3 to 5.

Figure 3:
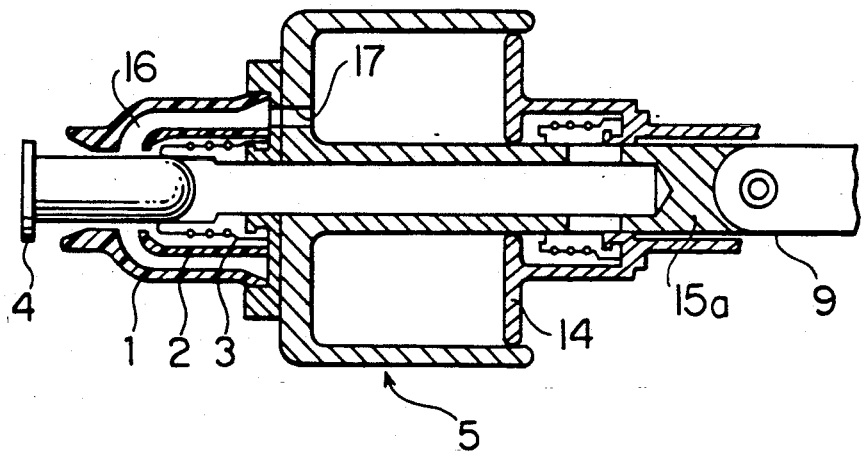
FIGS. 3 to 5 are sectional views for explanation of the operation of the circuit breaker shown in FIG. 1, wherein the interrupting section is in different states, respectively.
Figure 4:
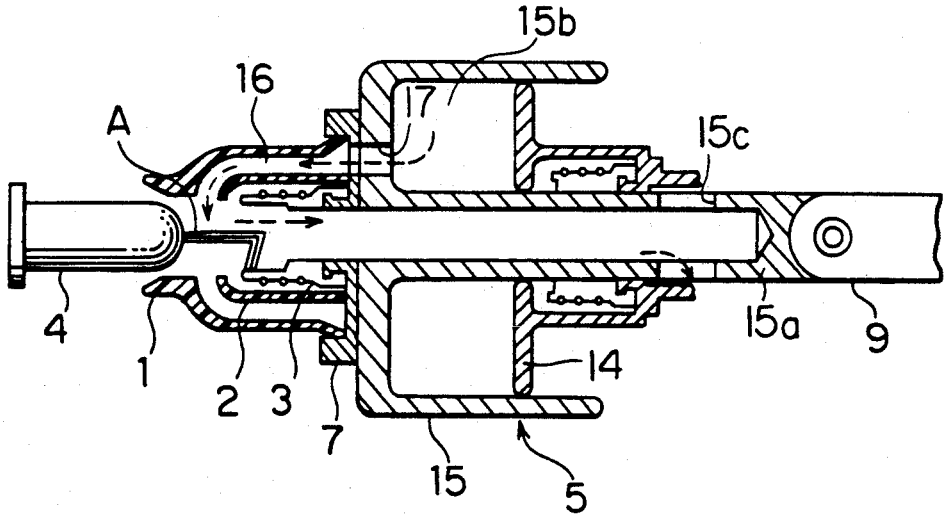

FIG. 3 illustrates the circuit breaker in its, closing state where the movable electrode 3 is positioned in contact with the stationary electrode, 4. The contact portion between the electrodes 3 and 4 is surrounded by the insulated nozzle 1 and the insulated cover 2. The current interruption operation is performed in this state through the operation of the operation unit (not shown) in response to an interruption command. By the driving of the operation unit, the drive shaft 9 is, as shown in FIG. 4, moved to the right when viewed in this drawing. The drive shaft 9 drives the movable electrode 3 via the cylinder 15 and the conductor 7 to separate the movable electrode 3 from the stationary electrode 4. At this time, an arc A occurs between the stationary and movable electrodes 3, 4 and extends between the electrodes as they are separated from each other.

Further, in response to the interrupting, operation, the gas compression device 5 is operated. More particularly, in accordance with the movement of the drive shaft 9, the puffer cylinder 15, the insulated nozzle 1 and the insulated cover 2 are moved to the right with respect to the piston 14 when viewed in the drawing. As a result, the piston 14 compresses the SF6 gas in the puffer chamber 15*b*, and the thus compressed gas blows through the gas passage 16 to the arc A to cool the same.

Figure 5:
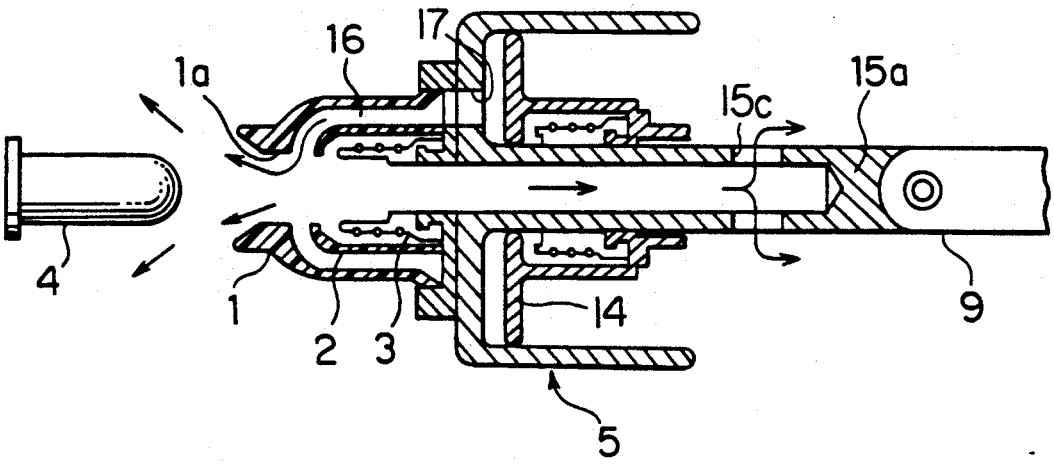

As shown in FIG. 5, when the stationary electrode 4 passes through the throat portion 1*a* of the insulated nozzle 1 the compressed as flows through the throat portion 1*a*. This strong blow of the SF6 gas extinguishes the arc and the interruption operation is completed. Incidentally, after the cooling of the arc, a part of the compressed gas is discharged into the gas tank 6 through the central shaft 15*a* of the puffer cylinder.

During the interruption operation, the insulated cover 2 is exposed to the arc. However, the insulated cover 2 is made of the fluororesin containing the filler of boron nitride powder as described above and therefore, invasion or penetration of the energy lines of the arc is prevented so that the generation of voids or carbon not only on the surface of the insulated cover 2 but also in the inside thereof can be avoided. Particularly, as the generation of carbon is prevented, even when a high recovery voltage acts between the electrodes 3 and 4 after the arc has been extinguished as shown in FIG. 5. The electric potential distribution at the front end of the movable electrode 3 confronting the stationary electrode is not disturbed unlike the conventional circuit breakers. Therefore, a satisfactorily improved voltage resistance can be obtained in the interrupting section and thereby the interrupting performance can be improved. Further, the generation of voids in the insulated cover 2 can be avoided and the flow of the blowing gas is not disturbed, so that the deterioration of the interrupting performance can not be brought about.

As described above, in a circuit breaker provided with a conventional insulated cover, there is a possibility that the flow of the blowing gas is adversely affected by the voids generated in the insulated cover or the carbon generated thereon adheres to the inner surface of the insulated nozzle and, therefore, the interrupting performance of the circuit breaker is deteriorated as compared with the case where only the insulated nozzle is provided. Contrarily, with the use of the insulated cover as described above in this embodiment, it is possible to allow the insulated nozzle 1 to satisfactorily exhibit its performance. Further, due to the effect of setting the gas passage 16 in order by the insulated nozzle 1 and the insulated cover 2 in addition to the above described merits, the SF6 gas-insulated circuit breaker which exhibits an excellent total interrupting performance as a whole can be obtained. In case that the insulated nozzle 1 is made of an ethylene tetrafluoride resin which contains boron nitride powder, any brittleness of the nozzle 1 due to increase in the content of the boron nitride can be prevented by setting the content of the boron nitride to be equal to or lower than that of the boron nitride in the insulated cover 2. Accordingly, the inner surface and the throat portion of the insulated nozzle can be maintained in a desired shape to maintain the stable performance even after a large number of interrupting operations.

Referring back to FIG. 1, the relationship of the field strength at the front end of the movable electrode will now be described.

Since the insulated cover 2 covers the front end portion of the movable electrode 3, electric field Ec on its surface is higher than electric field Em at the front end of the movable electrode 3. On the other hand, because the insulated cover 2 is made of the relatively smooth insulating material, the maximum permissible electric field strength on its surface can be set at a value higher than the surface electric field Em of the movable electrode 3. In the illustrated embodiment, the specific inductive capacity $\epsilon_c$ of the insulated cover 2 is higher than the specific inductive capacity of the insulated nozzle 1. To make the specific inductive capacity $\epsilon_c$ of the insulated nozzle 1 and the specific indicative capacity of the insulated cover 2 different from each other, a filler may be added to the material for the insulated nozzle an the material for the insulated cover. More specifically, the insulating material used to form portions of the interrupting section is usually a material of a low specific inductive capacity which is excellent in heat resistance and arc resistance and does not affect the electric field. The typical material is a fluororesin such as ethylene tetrafluoride of a specific inductive capacity $\epsilon_1=2.1$. Preferably the filler is a material which is selected in consideration of the arc resistance of the nozzle 1. An example of this preferable material is, the above-described boron nitride. The specific inductive capacity of the fluororesin varies in a range between about 2.1 to about 3.0 dependent upon the quantity of the boron nitride contained in the fluororesin.

Figure 6:
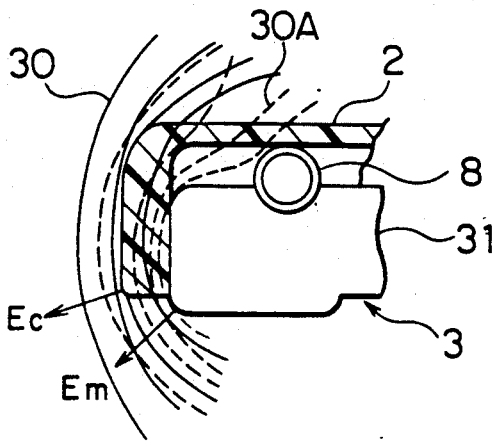
FIG. 6 is a schematic view which illustrates a state of the electric field at the front end of a movable electrode in the embodiment shown in FIG. 1.

Thus, by enlarging the specific inductive capacity of the insulated cover 2, the electric field at the front end of the movable electrode 3 can be reduced. That is, as shown in FIG. 6, the equipotential lines at the front end of the movable electrode 3 after the interruption can be shifted toward the stationary electrode 4 as indicated by continuous lines 30 in comparison with equipotential lines 30A indicated by dotted lines which take place in the case where the insulated cover 2 is not provided. As a result, the electric field strength on the front end side, of the movable electrode can be reduced, and the opening/closing performance in a small current region such as the opening/closing characteristic for a leading small current can be improved.

Figure 7:
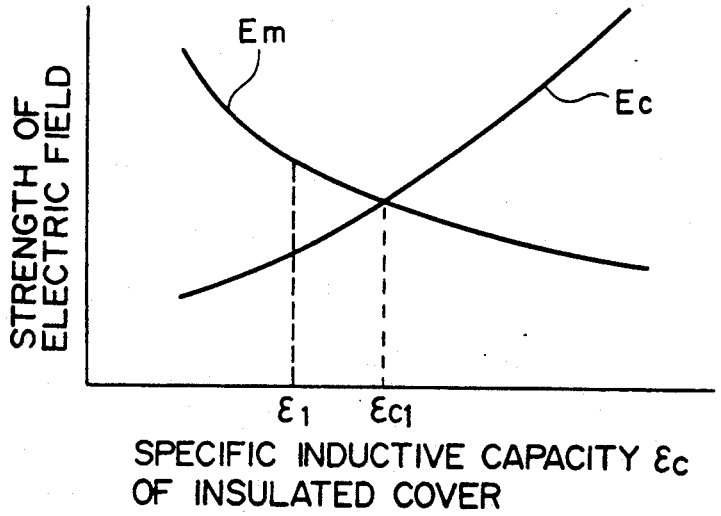
FIG. 7 is a graphical illustration of the relationship between the specific inductive capacity of an insulated cover and the electric fields at the front ends the movable electrode and insulated cover in the embodiment shown in FIG. 1.

FIG. 7 illustrates the relationship between the specific inductive capacity $\epsilon_c$ of the insulated cover 2 and the electric field strength at the front ends of the movable electrode 3 and the insulated cover 2. In FIG. 7, a characteristic curve Em represents a field strength of the movable electrode 3 and a characteristic curve Ec represents the field strength of the insulated cover 2. As apparent from FIG. 7, by making the specific inductive capacity of the insulated cover 2 greater than the specific inductive capacity $\epsilon_1$ of the ethylene tetrafluoride resin and further greater than the specific inductive capacity $\epsilon_{c1}$ of the insulated cover 2 which corresponds to the intersection between the characteristic curves Em and Ec, the field strength Em at the front end of the movable electrode 3 can be reduced. On the other hand, the field strength Ec at the front end of the insulated cover 2 becomes greater in accordance with the increment of the specific inductive capacity of the insulated cover 2. However, comparing the maximum permissible electric field of the electrode portion with that of the surface of the insulating material, the electrode portion is usually less than the insulating material although they depend on the surface roughness, because discharge of electric field takes place in the surface of the electrode portion. In other words, the permissible electric field of the surface of the insulating material can be higher than that of the electrode portion. In this viewpoint, according to the invention, the specific inductive capacity of the insulated cover is made larger so as to reduce the electric field strength at the front end of the movable, electrode 3. Specifically, when the insulated nozzle 1 is made of only the ethylene tetrafluoride resin, the insulated cover 2 may have a specific inductive capacity greater than the specific inductive capacity 2.1 of the insulated nozzle 1 by, for example, selection of the material and/or addition of the filler. Alternatively, when the insulated nozzle 1 contains boron nitride powder, the quantity of the boron nitride powder to be added to the insulated cover 2 may be set so as to make the specific inductive capacity of the insulated cover 2 greater than that of the insulated nozzle 1.

When the insulated cover 2 is made of the fluororesin containing the boron nitride as described above, the electric field strength at the front end of the movable electrode 3 can be reduced, an excellent arc resistance of the cover can be realized and damage or the like thereof can be reduced even when a large electric current is interrupted. As the filler for enlarging the specific inductive capacity of the insulated cover, another material, for example, powder of alumina, titanium oxide, kaoline clay, zinc white, barium sulfate or iron oxide red may be used in place of the boron nitride described above.

Figure 8:
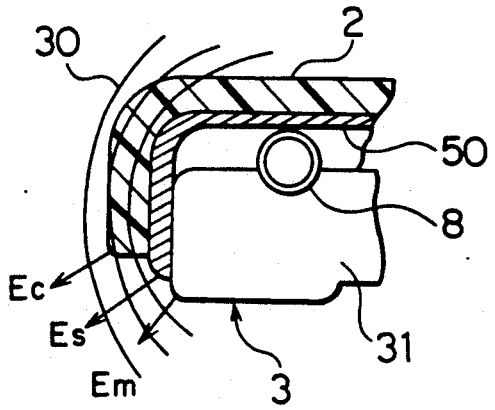
FIG. 8 is a sectional detail view of a portion of a gas-insulated circuit breaker according to another embodiment of the invention.

Although, in the above-described embodiment, the insulated cover 2 is provided directly around the movable electrode 3, a metal cylinder member 50 may be provided inside the insulated cover 2 as shown in FIG. 8. In this case, the shape of the front end of the cylindrical member 50 may contribute to the reduction of the electric field $E_s$ at the front end thereof as well as at the front end of the movable electrode 3. Additionally, the metal cylindrical member 50 has a shielding effect against the electric field concentration to the spring 8 or the like, and the insulating characteristics can further be improved. Also in the embodiment of FIG. 8, the electric field at the front end of the movable electrode 3 can be, similarly to the above-described embodiment, reduced through the formation of the insulated cover 2.

As described above, according to the invention, the insulated cover is disposed between the insulated nozzle 1 and the electrode 3 to define the gas passage 16 in cooperation with the insulated nozzle 1. The insulated cover 2 is made of the insulating material which contains the filler for preventing the invasion or penetration of the energy lines of the arc, and prevents the generation of carbon and voids and thereby the influence thereof upon the insulated nozzle. As a result, an SF6 gas-insulated circuit breaker can be obtained, which exhibits interrupting performance improved by the cooperation of the insulated nozzle 1 and the insulated cover 2. Furthermore, according to the invention, the electric field strength Ec at the front end of the movable electrode 3 can be reduced even when the nozzle 1 is made of the insulating material which is of a high specific inductive capacity and excellent in arc resistance is used. As a result, it is possible to improve not only the opening/closing performance in a small electric current region such as a leading small current opening/closing characteristic but also the interrupting performance for a large electric current.

Although the invention has been described on the basis of the embodiments, it should be understood that the invention is not limited to those specific forms and many modifications can be made or the invention takes other forms without departing from the scope of the appended claims.

What is claimed is:

1. A gas-insulated circuit breaker for opening and closing an electric circuit comprising:

a stationary electrode;

a movable electrode movable into and out of contact with said stationary electrode;

gas compression means for causing an insulating gas to flow when said movable electrode separates from said stationary electrode;

cover means for covering said movable electrode; and nozzle means for forming, in cooperation with said cover means, a passage for introducing said insulating gas from said gas compression means to an arc occurring between said stationary electrode and said movable electrode when said movable electrode moves out of contact with the stationary electrode, wherein at least said cover means is made of an insulating material containing a filler for preventing energy lines of the arc from entering said cover means, said cover means being shaped so as to cover an outer periphery of the movable electrode and a front end thereof disposed in opposition to the stationary electrode, and wherein the cover means has a specific inductive capacity greater than a specific inductive capacity of the nozzle means.

2. The circuit breaker according to claim 1, wherein said nozzle means is made of the same insulating material as that of said cover means.

3. The circuit breaker according to claim 2, wherein said insulating material for said nozzle means contains the same filler as that of said cover means and an amount of said filler in said cover means is equal to or greater than an amount of said filler in said nozzle means.

4. The circuit breaker according to claim 1, wherein said insulating material is a fluororesin.

5. The circuit breaker according to one of claims 1 or 3, wherein said insulating material is an ethylene tetrafluoride resin.

6. The circuit breaker according to claim 3, wherein said filler is powder of boron nitride.

7. The circuit breaker according to claim 1, wherein said insulating gas is a sulfur hexafluoride ($SF_6$) gas.

8. The circuit breaker according to claim 1, wherein said cover means is substantially cylindrically shaped.

9. The circuit breaker according to claim 2, wherein said insulating material is a fluororesin.

10. The circuit breaker according to claim 9, wherein said insulating material is an ethylene tetrafluoride resin.

11. The circuit breaker according to claim 2, wherein said filler is any one selected from powders of boron nitride, alumina, titanium oxide, kaoline clay, zinc white, barium sulfate and iron oxide red.

12. The circuit breaker according to claim 1, wherein insulating material for said cover means is an insulating material for moving equipotential lines on a movable electrode side toward said stationary electrode when said movable electrode separates from said stationary electrode.

13. The circuit breaker according to claim 1 further comprising a metal cylindrical member provided between said cover means and said movable electrode.

* * * * *